US011199067B2

(12) United States Patent
Carragher et al.

(10) Patent No.: US 11,199,067 B2
(45) Date of Patent: Dec. 14, 2021

(54) THERMALLY DEFORMABLE ANNULAR PACKERS

(71) Applicant: BiSN Tec Ltd, Cheshire (GB)

(72) Inventors: Paul Carragher, Lymm (GB); Sylvain Bedouet, Houston, TX (US)

(73) Assignee: BiSN Tec Ltd, Cheshire (GB)

( * ) Notice: Subject to any disclaimer, the term of this patent is extended or adjusted under 35 U.S.C. 154(b) by 0 days.

(21) Appl. No.: 16/589,012

(22) PCT Filed: Apr. 4, 2018

(86) PCT No.: PCT/GB2018/050909
§ 371 (c)(1),
(2) Date: Sep. 30, 2019

(87) PCT Pub. No.: WO2018/185482
PCT Pub. Date: Oct. 11, 2018

(65) Prior Publication Data

US 2020/0248526 A1 Aug. 6, 2020

(30) Foreign Application Priority Data

Apr. 4, 2017 (GB) ..... 1705420
May 11, 2017 (GB) ..... 1707587

(51) Int. Cl.
*E21B 33/12* (2006.01)

(52) U.S. Cl.
CPC ..... *E21B 33/1208* (2013.01)

(58) Field of Classification Search
CPC ..... E21B 33/1208; E21B 33/1212
See application file for complete search history.

(56) References Cited

U.S. PATENT DOCUMENTS 1,534,229 A 4/1925 Livergood
2,076,308 A 4/1937 Wells
(Continued)

FOREIGN PATENT DOCUMENTS

CA 2592556 6/2007
EP 1 933 004 6/2008
(Continued)

OTHER PUBLICATIONS

Jul. 27, 2018, PCT, PCT/GB2018/050909 Opinion.
Jul. 27, 2018, PCT, PCT/GB2018/050909 search report.

*Primary Examiner* — Kristyn A Hall
(74) *Attorney, Agent, or Firm* — Glen P. Belvis; Belvis Law, LLC.

(57) ABSTRACT

The present invention provides a thermally deformable annular packer with pressure relief means for use in oil and gas wells. The annular packer is formed from a stack of component parts, said parts comprising one or more eutectic alloy based ring sections sandwiched between two end sections. At least one of the annular packer component parts has one or more enclosed voids that are configured to become exposed when the packer is subjected to a predetermined pressure or temperature. The exposure of the enclosed voids serves to increase the effective volume within the sealed region formed by the annular packer in the annulus between two coaxial well casing/tubing. The increase in the effective volume serves to reduce the pressure within the sealed region thus preventing a build-up of pressure that might otherwise have damaged the well casing/tubing.

37 Claims, 8 Drawing Sheets

(56) References Cited

U.S. PATENT DOCUMENTS

| | | | | |
|---|---|---|---|---|
| 2,686,689 | A | 8/1954 | Douglas | |
| 2,789,004 | A | 4/1957 | Forster | |
| 2,822,876 | A | 2/1958 | Murrow | |
| 3,119,451 | A | 1/1964 | Hall | |
| 3,170,516 | A | 2/1965 | Corley | |
| 3,208,530 | A | 9/1965 | Allen | |
| 3,871,315 | A | 3/1975 | Andersen | |
| 4,134,452 | A | 1/1979 | Kingelin | |
| 4,423,783 | A | 1/1984 | Haag | |
| 4,488,747 | A | 12/1984 | Austin | |
| 4,523,640 | A | 6/1985 | Wilson | |
| 4,696,343 | A | 9/1987 | Anderson | |
| 5,052,489 | A | 10/1991 | Carisella | |
| 5,279,370 | A * | 1/1994 | Brandell | E21B 33/128 166/386 |
| 5,564,861 | A | 10/1996 | Khudenko | |
| 6,102,120 | A | 8/2000 | Chen | |
| 6,454,001 | B1 | 9/2002 | Thompson | |
| 6,474,414 | B1 | 11/2002 | Gonzalez | |
| 6,664,522 | B2 | 12/2003 | Spencer | |
| 6,828,531 | B2 | 12/2004 | Spencer | |
| 6,923,263 | B2 | 8/2005 | Edin | |
| 7,152,657 | B2 | 12/2006 | Bosma | |
| 7,290,609 | B2 | 11/2007 | Wardlaw | |
| 2002/0162596 | A1 | 4/2002 | Simpson | |
| 2002/0056553 | A1 | 5/2002 | Duhon | |
| 2003/0132224 | A1 | 7/2003 | Spencer | |
| 2004/0261994 | A1 | 12/2004 | Nguyen | |
| 2005/0109511 | A1 | 5/2005 | Spencer | |
| 2006/0144591 | A1 | 7/2006 | Gonzalez | |
| 2007/0051514 | A1 | 3/2007 | La Rovere | |
| 2010/0006289 | A1 | 1/2010 | Spencer | |
| 2010/0126735 | A1 | 5/2010 | Allison | |
| 2010/0263876 | A1 | 10/2010 | Frazier | |
| 2011/0132223 | A1 | 6/2011 | Streibich | |
| 2011/0146519 | A1 | 6/2011 | Han | |
| 2011/0174484 | A1 | 7/2011 | Wright | |
| 2011/0214855 | A1 | 9/2011 | Hart | |
| 2012/0199351 | A1 | 8/2012 | Roberston | |
| 2012/0298359 | A1 | 11/2012 | Eden | |
| 2012/0312561 | A1 | 12/2012 | Hallundaek | |
| 2013/0087335 | A1 | 4/2013 | Carraher | |
| 2013/0192833 | A1 | 8/2013 | Gano | |
| 2014/0318782 | A1 | 10/2014 | Bourque | |
| 2015/0211326 | A1 | 7/2015 | Lowry | |
| 2015/0211327 | A1 | 7/2015 | Lowry | |
| 2015/0211328 | A1 | 7/2015 | Lowry | |
| 2015/0345248 | A1 | 12/2015 | Carragher | |
| 2015/0368542 | A1 | 12/2015 | Carragher | |
| 2016/0145962 | A1 | 5/2016 | Carragher | |
| 2016/0319633 | A1 | 11/2016 | Cooper | |
| 2017/0030162 | A1 | 2/2017 | Carragher | |
| 2017/0089168 | A1 | 3/2017 | Carragher | |
| 2017/0226819 | A1 | 8/2017 | Carragher | |
| 2017/0234093 | A1 | 8/2017 | Carragher | |
| 2017/0234100 | A1 | 8/2017 | Carragher | |
| 2017/0306717 | A1 | 10/2017 | Carragher | |
| 2019/0085659 | A1 | 3/2019 | Carragher | |
| 2019/0014355 | A1 | 5/2019 | Carragher | |
| 2019/0186230 | A1 | 6/2019 | Carragher | |
| 2020/0173250 | A1 | 6/2020 | Carragher | |
| 2020/0248526 | A1 | 8/2020 | Carragher | |
| 2020/0332620 | A1 | 10/2020 | Carragher | |

FOREIGN PATENT DOCUMENTS

| | | | | |
|---|---|---|---|---|
| GB | 2016063 | 9/1979 | | |
| GB | 2 164 886 | 4/1986 | | |
| WO | WO 2011/151171 | 12/2011 | | |
| WO | WO 2013/066340 | 5/2013 | | |
| WO | WO2016024122 | * 2/2016 | | E21B 29/10 |

* cited by examiner

THERMALLY DEFORMABLE ANNULAR PACKERS

This application is a national stage entry under 35 U.S.C. § 371 of PCT/GB2018/050909 filed Apr. 4, 2018, and which claims priority to GB 1705420.6 filed Apr. 4, 2017 and GB 1707587.0 filed May 11, 2017, the entire disclosures of each of which are incorporated herein by reference.

FIELD OF THE INVENTION

The present invention relates to apparatus used in the formation and maintenance of oil and gas wells, and in particular the stackable thermally deformable annular packers employed during the creation and repair of oil and gas wells.

BACKGROUND OF THE INVENTION

In order to access oil and gas deposits located in underground formations it is necessary to drill bore holes into the underground formations and deploy production tubing to facilitate the extraction of the oil and gas deposits.

Additional tubing, in the form of well lining or well casing, may also deployed in locations where the underground formation is unstable and needs to be held back to maintain the integrity of the oil/gas well.

During the formation and completion of an oil/gas well it is crucial to seal the annular space created between the casing and the surrounding formation. This is also the case for the annular space between the overlapping casing of different sizes used as the well is completed. Additionally, the annular space between the production tubing and said casing needs to be sealed. Further seals may be required between the underground formation and the additional tubing.

One of the most common approaches to sealing oil/gas wells is to pump cement into the annular spaces around the casing and/or tubing. The cement hardens to provide a seal which helps ensure that the casing/tubing provides the only access to the underground oil and gas deposits. This is crucial for both the efficient operation of the well and controlling any undesirable leakage from the well during or after the well is operated.

However, it is not uncommon for cracks/gaps (sometime referred to as micro annuli) to form in these cement seals over time. This can lead to unwanted leakage from the well. One location where such cracks/gaps can form is at the interface between the production tubing and the cement seal.

In particular, when an oil/gas well is being operated in a periodic, stop/start, manner, the temperature within the production tubing can fluctuate significantly over time. These temperature fluctuations can cause the diameter of the production tubing to expand and contract. This movement applies pressure to the cement seal that can lead to the formation of small cracks/gaps in the seal, through which leakage can occur.

In order to address the formation of such cracks/gaps in the cement seal it is known to deploy eutectic alloy, such as bismuth alloy, into the annular space and then heat the alloy so that it melts and flows into the cracks/gaps. The alloy is then allowed to cool, wherein it expands to form an effective seal within the annular space.

However there are disadvantages to this approach, not least because it requires at least a partial dismantling of the well so that the alloy can be deployed within the annular space. This can be time consuming and costly in terms of the down time of the well.

Another issue with this approach is the need to ensure that the alloy is delivered to the target region of the well in a consistent and uniform manner so that the amount of heat required for melting the alloy can be effectively pre-calculated, for example. This is important given that the process usually takes place deep underground and must be controlled remotely.

The above problems were initially addressed in International PCT application no. PCT/GB2015/052347, which describes thermally deformable annular packers and their use in forming seals in the annular spaces within oil and gas wells.

SUMMARY OF THE INVENTION

The present invention provides improvements relating to thermally deformable annular packers and in particular thermally deformable annular packers that are formed from a stack of component parts.

As detailed in PCT/GB2015/052347, thermally deformable annular packers can be formed from a stack of component parts. Essentially the stack comprises one or more eutectic/bismuth alloy based ring sections sandwiched between a leading end section, which enters the well bore first, and the trailing end section.

Advantageously, although not essentially, the end sections may be provided with sealing means that are configured to facilitate the formation of a seal between the annular packer and an adjacent well casing or tubing, for example.

It has now been discovered that the formation of the sealed region between the end sections of the annular packer can sometimes lead to a pressure build-up within the sealed region under down-hole conditions. This pressure build-up can lead to deformation, and even collapse, of the tubing/casing on either side of the annular region. Any such failure would involve costly repairs and, perhaps more crucially, enforced closure of the well.

The pressure build-up between the end sections of the annular packer can occur when fluid trapped within the sealed region is heated. Although this may occur under normal environmental conditions down-hole, it is appreciated that the temperature increase achieved when melting the eutectic alloy of the thermally deformable annular packers is likely to exacerbate the pressure build-up.

In order to address this problem the present invention provides a thermally deformable annular packer for use in oil and gas wells, said annular packer comprising a stack of component parts, said parts comprising one or more eutectic alloy based ring sections sandwiched between two end sections; and wherein at least one of the stacked component parts is provided with one or more enclosed voids that are configured to be exposed when the packer is subject to a predetermined pressure or temperature.

It is envisioned that the enclosed void may be provided in the end section component and/or the ring section component of the thermally deformable annular packer of the present invention.

Therefore, a first aspect of the present invention provides a thermally deformable annular packer for use in oil and gas wells, said annular packer comprising a stack of component parts, said parts comprising one or more eutectic alloy based ring sections sandwiched between two end sections; wherein at least one of the annular packer end sections has one or more blind holes provided in a surface of the end section that faces into the stack, each blind hole comprising an opening in said surface and a void within the end section; and wherein the opening of each blind hole is blocked by a pressure actuated means that is configured to fail when subject to a predetermined pressure such that the enclosed void within the end section can be accessed through the opening.

Blocking the blind hole with a pressure actuated means provides a pressure relief in situations when there is an unwanted build-up of pressure between the sealed region formed between the end sections of the thermally deformable annular packer.

Essentially, when the pressure within the sealed region reaches a predetermined level the pressure actuated means blocking off the void of each blind hole fails, thereby opening fluid communication between the sealed region defined by the end sections and the void(s). This effectively increases the volume of the sealed region which, it will be appreciated, leads to a reduction in pressure within the sealed region.

Preferably the pressure actuated means may comprise a pressure actuated device (PAD) positioned at the opening of each blind hole. Further preferably the pressure actuated device may comprise a burst/rupture disc. It is appreciated that the facility to control the fail pressure of pressure actuated devices, such as burst/rupture discs, is known.

Preferably each void may either be at a reduced pressure or completely evacuated when blocked. In this way the effectiveness of the pressure relief when the blind holes are unblocked can be increased.

Alternatively the pressure actuated means may comprise a compressible material positioned within, and at least partially filing, the void of each blind hole. Further preferably, the compressible material may be a foam, plastic or rubber material. It is envisaged that the density of these materials can be selected to provide the desired fail pressure. In this way the material is compressed at a pressure that is below the collapse or burst pressure of the surrounding casing.

It is appreciated that the effectiveness of the pressure relief system can also be enhanced by increasing the number of blind holes and/or the volume of their voids. In this way the total volume of the void space within the end section is increased.

In this regard, it is noted that although said blind holes may be provided in both annular packer end sections this is not essential. Preferably the blind holes are, in use, provided at least in the end section located at the trailing end of the annular packer.

This is advantageous because the gases or fluids trapped within the sealed region, which can expand and create the pressure build up, tend to rise to the top of the sealed region (i.e. towards the end of the annular packer located further up the wellbore).

Preferably each void may extend between 20% to 85% of the way into the body of said end section. However, ultimately the maximum depth of the void will be determined by the length and thickness of side walls of the end section, as well as the material used to manufacture the end section. It is appreciated that the void must not extend so far into the end section that it weakens the either the base or the side walls of the end section.

Preferably at least one of the annular packer end sections comprise a tapered region, which, in use, is located at a leading and/or trailing end of the stack. Providing a tapered region on the leading end section, in particular, helps to guide the annular packer as it deployed down hole and, in so doing, reduce the damage caused to the annular packer by collisions with down-hole obstacles.

Preferably the end sections comprise a flange that extends radially outwards beyond the sandwiched ring sections. In this way the end sections, which are preferably made of a more durable material than the softer eutectic/bismuth alloy ring sections, protect the ring sections that are sandwiched between them.

Preferably each end section is provided with a compressible, preferably rubber, sealing means on an outer surface thereof, said compressible sealing means extend beyond the outer edge of end section.

As mentioned above the sealing means are configured to facilitate the formation of a seal between the annular packer and an adjacent well tubing or casing, for example.

It is appreciated that it is not essential for the end sections to have sealing means because the sealing effect provided by the cement that is used to initially seal the annular space also contributes to the formation of the sealed region.

Preferably the pressure actuated means may be configured to fail at a pressure that is lower than the pressure tolerance of well casing and/or tubing located on either side of the sealed region of the annular space. In this way the pressure relief is only triggered when there is a build-up of pressure within the sealed region that could damage the surrounding well casing and/or tubing.

By way of example, typically the absolute down-hole pressure is about 2500 PSI and the burst rating of the well casing is about 5500 PSI. Within these parameters it is envisaged that the pressure actuated means of the present invention would be suitably configured to fail at a pressure or 3500 PSI, which is above the down-hole pressure but well below the pressure at which the well casing might fail.

Preferably the total volume of the void space provided within the end section may be at least 33 ml (2 cubic inches) and preferably at least 66 ml (4 cubic inches). It is appreciated that the total volume provided in an end section may be increased further as the number of eutectic rings sandwiched between the end sections is increased. This is because increasing the number of rings increases the size of the sealed region formed between the end sections, which in turn increases the amount of gases/fluid that can become trapped in the sealed region.

It is envisaged that the end section of the above described thermally deformable annular packers is constructed as a stand-alone component.

Therefore, a second aspect of the present invention provides an end section component of a stacked thermally deformable annular packer for use in oil and gas wells, said end section comprising: a tubular body with a first surface that, in use, faces towards the other component parts of the stacked thermally deformable annular packer; at least one blind hole provided in the first surface, each hole comprising an opening in said surface and a void within the tubular body; and wherein the opening of each blind hole is blocked by a pressure actuated means that is configured to fail when subjected to a predetermined pressure such that the enclosed void within the end section can be accessed through the opening.

It will be appreciated that the preferable features described in relation to the end section when part of the thermally deformable annular packer are also applicable to the standalone end section component of the present invention.

It is envisaged that the pressure relief benefit achieved by releasing the enclosed voids to increase the total volume within the sealed region may also be realised by providing enclosed void spaces within the eutectic/bismuth alloy ring sections instead of, or in addition to, the end sections.

Therefore, in a third aspect, the present invention provides a thermally deformable annular packer for use in oil and gas wells, said annular packer comprising a stack of component parts, said parts comprising one or more eutectic alloy based ring sections sandwiched between two end sections; and wherein at least one of the annular packer ring sections is provided with one or more enclosed voids that are configured to become exposed when the ring sections melt.

In use, heating the thermally deformable annular packer causes the isolated void space within the eutectic/bismuth alloy rings sections to become exposed, which, as with the exposure of the void spaces in the end sections, serves to increase the effective volume of the sealed region formed between the end sections of the thermally deformable annular packer.

Preferably, each enclosed void may be either at a reduced pressure or completely evacuated. In this way the effectiveness of the pressure relief when the enclosed voids are exposed can be increased.

Preferably the enclosed voids comprise blind holes provided in a surface of the ring section that faces other components of the stack, each blind hole comprising an opening in said surface and a void within the ring section; and wherein the opening of each blind hole is blocked by cap that encloses the void of each blind hole.

It will be appreciated that, although the exposure of enclosed voids in the ring sections may be achieved by melting the cap, the actual melting of the eutectic/bismuth alloy, from which the ring sections are formed, will also have the same result; i.e. releasing the enclosed void and increasing the effective volume of the sealed region.

Preferably the cap may be formed from steel; however other materials may be suitable. Ideally the cap will be formed from a material that melts at around the same temperature as the eutectic/bismuth alloy. However, this is not essential given that the melting of the ring section component releases the enclosed voids.

Preferably the thermally deformable annular packer comprises enclosed voids in both the end sections and the ring sections of the stack. It is envisaged that, because the end sections are pressure actuated and the ring sections are temperature actuated, using a combination of both can provide a two-stage pressure relief system.

In particular, it is envisaged that the initial pressure relief may be provided by releasing the enclosed voids in the ring sections, then, if required, a back-up pressure relief may be provided by the pressure actuated system provided in the end sections.

Preferably the ring sections comprise one or more conduits extending between the first and second component facing surfaces of the ring section. It will be appreciated that the conduits allow cement to pass through the ring sections. Similar, aligned, conduits are also provided in the end sections of the thermally deformable annular packer to facilitate passage of cement through the entire packer.

Preferably the blind holes and the conduits are arranged in an alternating pattern around each ring section.

Additionally, or alternatively, the blind holes may be provided on more than one of the surfaces of the ring section that face other components of the stack. In this way the blind holes may be alternated on either surface of the ring sections so as to avoid weakening the structural strength of the component.

Preferably the total volume of the enclosed voids may be at least 33 ml (2 cubic inches) and further preferably at least 66 ml (4 cubic inches).

In a fourth aspect the present invention provides a ring section component of a stacked thermally deformable annular packer for use in oil and gas wells, said ring section comprising: a tubular body formed from a eutectic or bismuth-based alloy, the body having a first surface that, in use, faces towards other component parts of the stacked thermally deformable annular packer; and wherein the tubular body of the ring section is provided with one or more enclosed voids that are configured to become exposed when the ring sections melt.

Preferably the enclosed voids comprise blind holes provided in the first surface of the ring section, each blind hole comprising an opening in said surface and a void within the tubular body of the ring section; and wherein the opening of each blind hole is blocked by cap that encloses the void of each blind hole within the tubular body of the ring section.

It will be appreciated that the preferable features described in relation to the ring section when part of the thermally deformable annular packer are also applicable to the standalone ring section of the present invention.

It will also be appreciated that the various aspects of the present invention can be used in combination to provide thermally deformable annular packers having additional benefits (i.e. two-stage pressure relief).

BRIEF DESCRIPTION OF THE DRAWINGS

The present invention will now be described with reference to the preferred embodiments shown in drawings, wherein.

DETAILED DESCRIPTION OF THE VARIOUS ASPECTS OF THE PRESENT INVENTION

The various aspects of the present invention will now be described with reference to the Figures, which provide a collection of diagrammatic representations of embodiments of each aspect of the present invention to aid in the explanation of their key features.

Although not shown in all the Figures it will be appreciated that typically the eutectic/bismuth alloy annular packer of the present invention will be mounted on an oil/gas tubing before it is deployed down a well. Although the term annular packer is used throughout it is appreciated that the term thermally deformable annulus packer is also an appropriate description given the eutectic/bismuth based alloy aspect of the described annular packers. The terms can therefore be used interchangeably.

It will be appreciated that, unless otherwise specified, the materials used to manufacture the components of the various apparatus described hereinafter will be of a conventional nature in the field of oil/gas well production.

Figure 1:
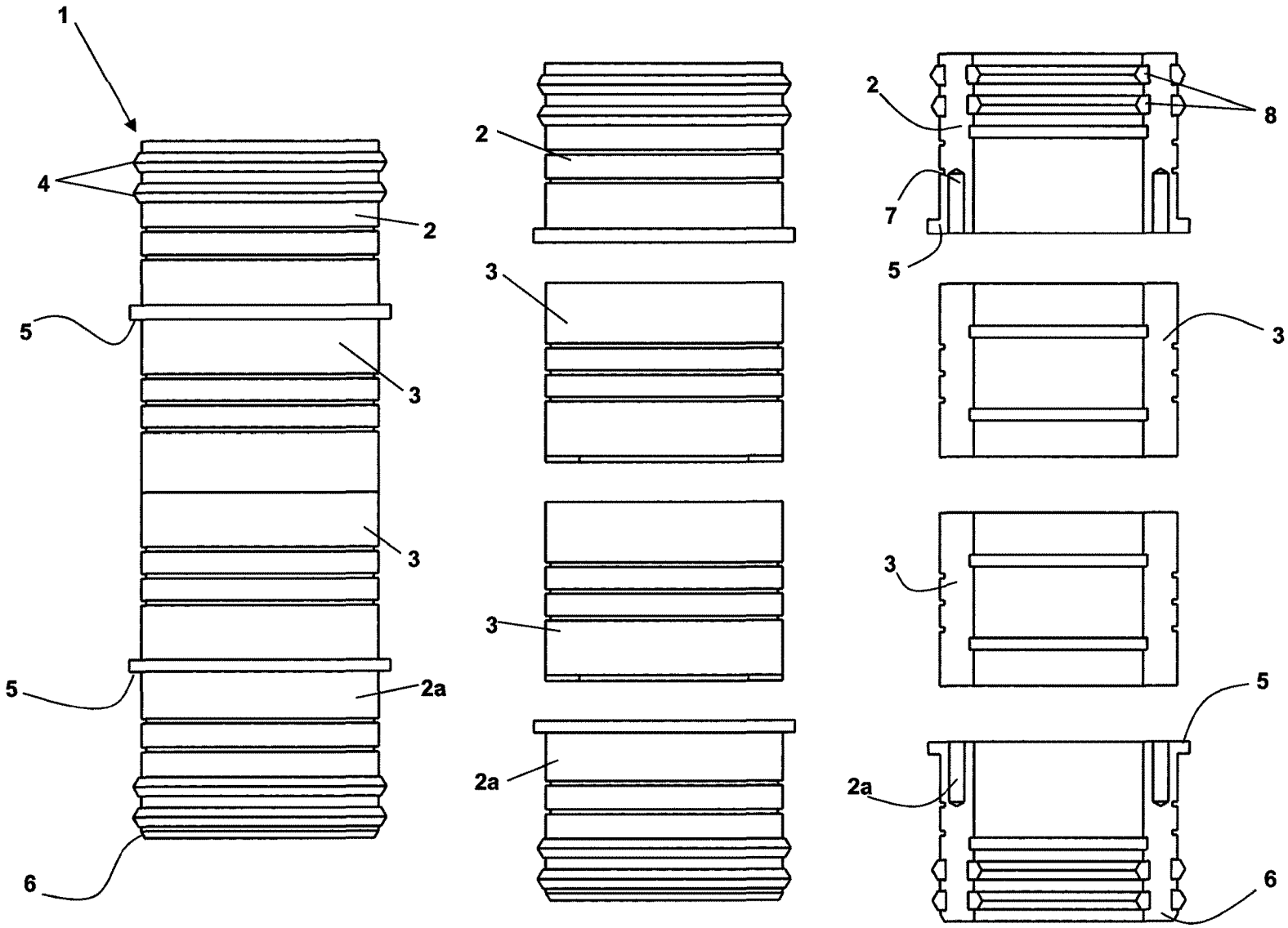
FIG. 1 shows various views of a stackable thermally deformable annular packer according to a preferred embodiment of the present invention.

FIG. 1 shows three views (a combined, an exploded, and a cross-sectional) of a stackable thermally deformable annular packer 1 in accordance with the present invention. The annular packer 1 is shown without a well casing/tubing as such is not essential to the provision of an operational annular packer.

As will be best appreciated from the exploded view, in the example shown the packer 1 is formed from two end sections 2, 2*a* and two middle ring sections 3 all of which are joined together with connection means (not shown).

Although not shown it is envisaged that that the connection means may be in the form of pairs of nuts and bolts located around the perimeter of the annular packer.

Figure 7:
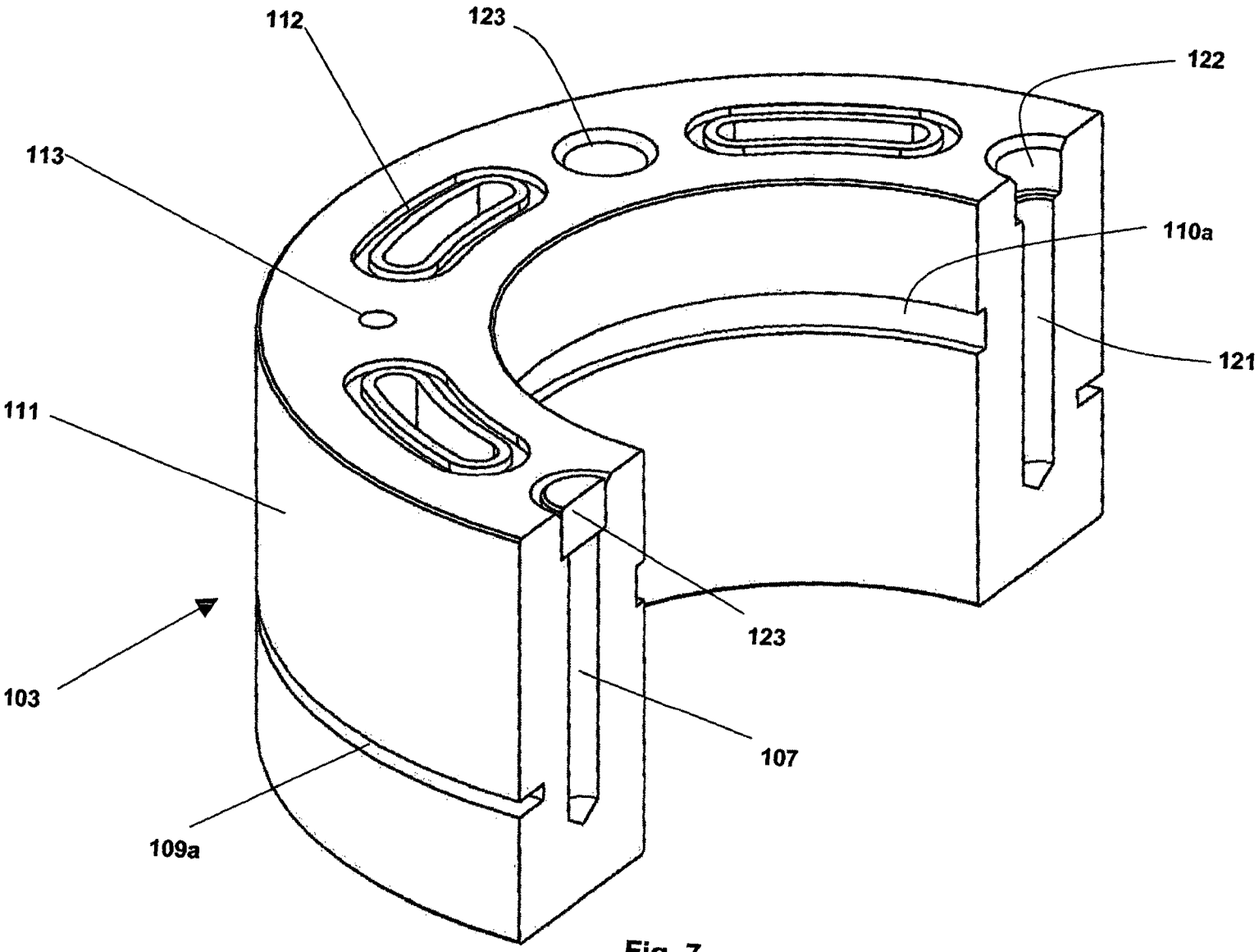
FIG. 7 shows a cross-sectional view of a ring section of a thermally deformable annular packer of the present invention.

Alternatively the connection means may be in the form complementary apertures and dowel pins located at the faces where adjacent sections contact one another. This arrangement ensures that the sections are aligned correctly with one another, which is particularly important when the sections are provided with cement by-pass channels. Both the complementary apertures and the cement by-pass channels/conduits are shown in FIG. 7, which is described in more detail below.

It is envisaged that sections connected in this way may additionally be held together on a well tubing by one or more stop collars provided at the ends of the stackable thermally deformable annular packer. It is also envisioned that one end of the stackable thermally deformable annular packer may be pushed up against a connection (i.e. collar where two pipes connect), in which case a stop collar may not be required at the end that abuts the connection.

Figure 2:
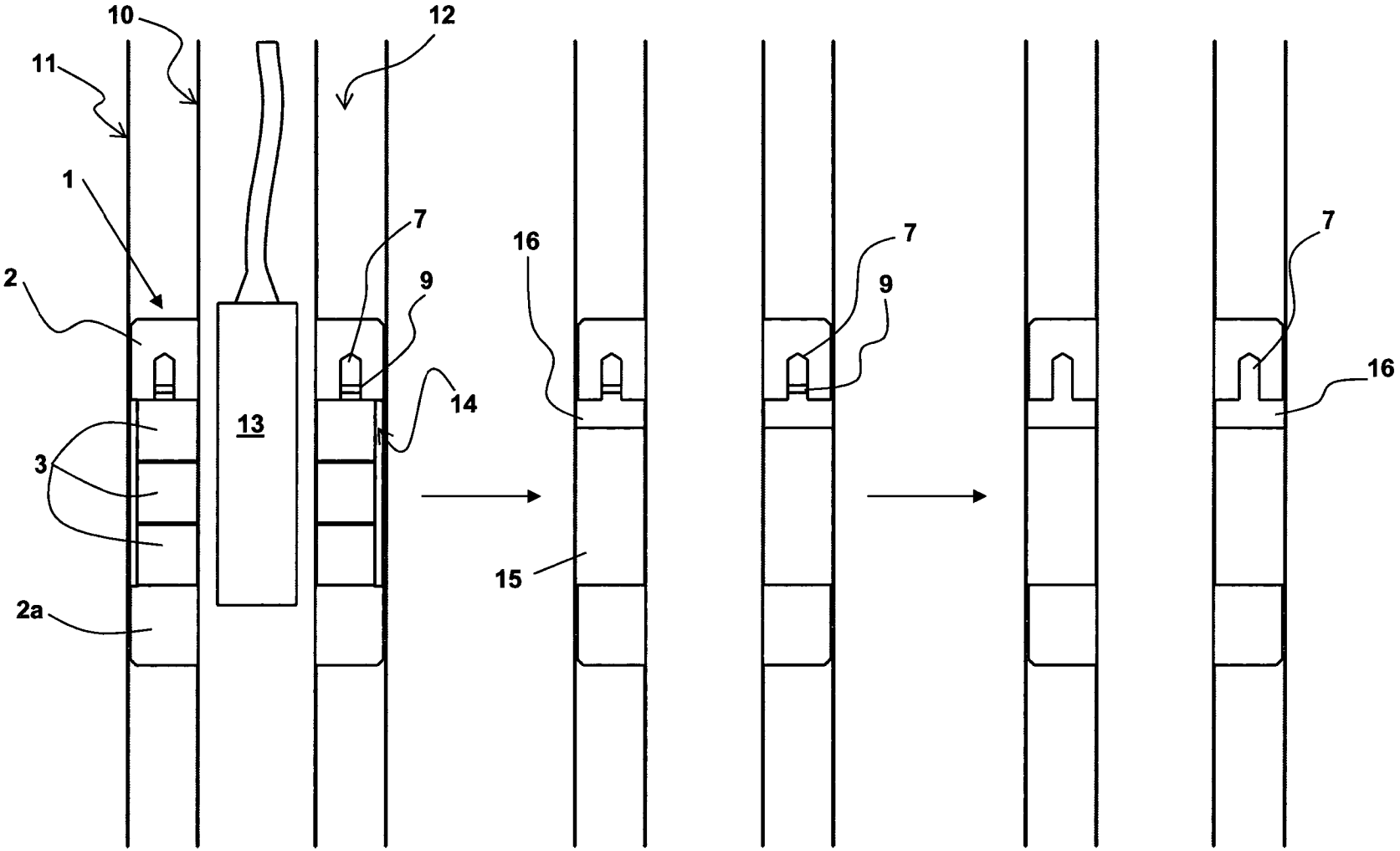
FIG. 2 shows a diagrammatic representation of the thermally deformable annular packer being operated within a well bore annulus.

Although the shown example only has four sections it is envisaged that the number of middle sections 3 can be reduced or increased to vary the length of the annular packer, thus making the stackable thermally deformable annular packer flexible for a range of repair jobs. For example, FIG. 2 shows a stack with three middle ring sections 3.

The middle ring sections 3 are formed from a eutectic or bismuth-based alloy, preferably by casting and milling or turning. It will be appreciated that it is these middle ring sections that melt and subsequently cool to form a seal within the annulus during the operation of the thermally deformable annular packer of the present invention.

It is appreciated that eutectic or bismuth-based alloys can be soft, and as such more vulnerable to damage during the deployment of the thermally deformable annular packer down hole.

In view of this, and in order to protect the middle ring sections 3, the end sections 2, 2*a* are advantageously formed from a more resilient material such as steel, aluminium, plastic, carbon fibre, fibreglass or resin. In this way the end sections, and in particular the leading end section 2*a*, can absorb the bumps and collisions that occur as the thermally deformable annular packer is deployed into the well bore.

The passage of the thermally deformable annular packer 1 is made easier by the provision of a taper 6 on the leading edge of the leading end section 2*a*.

In addition, the end sections 2, 2*a* are provided with flanges 5 that extend radially outwards beyond the outer circumference of the middle ring sections 3 so as to provide further protection to the softer eutectic or bismuth-based alloy of the middle ring sections.

It should be noted that the extent to which the flanges extend away from the main body has been exaggerated in FIG. 1 to aid in the explanation of their function.

The end packer sections 2, 2*a* are preferably provided with one or more rubber seals 4. It should be appreciated that in practise the rubber seals must project radially outwards to a greater extent than the flanges 5 so as to facilitate the formation of a seal between the annular packer 1 and the tubing into which the packer 1 is inserted.

In the shown example two rubber seals are provided on each end section so as to allow for one of the seals to fail. However it is envisioned that more or less seals of smaller or bigger design may be provided on the outside of the end sections (e.g. see FIG. 3).

Turning now to the cross-sectional view of the stackable annular packer 1, it will be seen that further seals 8 may also be provided on the inner surface of the annular packer 1. The seals 8, which are only provided on the end sections 2, 2*a*, are similar in nature to the externally mounted seals 4 shown in FIG. 1. The internal seals 8 facilitate the formation of a seal with the inner tubing 10, upon which the annular packer is to be mounted.

Also shown in the cross-sectional view of FIG. 1 is a blind hole 7 that forms part of the pressure relief system of the first and second aspects of the present invention. The general operation of the pressure relief system will now be described with reference to FIG. 2, which shows the key steps of the operation of a thermally deformable annular packer 1 of the present invention.

In use, the thermally deformable annular packer 1 is deployed in the annulus 12 between an inner well tubing 10 and an outer well tubing/casing 11. It is envisaged that the packer 1 may be secured outside of the inner well tubing 10 and then deployed down hole into the outer well tubing/casing 11; however, this is not essential to the operation of the pressure relief system of the present invention.

As detailed previously in PCT/GB2015/052347, the annular packer may be deployed, but not used, when a well is being completed by sealing the well annulus 12 with cement. It will be appreciated that the sealing facility provided by the thermally deformable annular packer may only be called upon when a fault develops in the cement seal.

The seals 4, 8 provided on the end sections 2, 2*a* facilitate the formation of seals with both the inner well tubing 10 and the outer well tubing/casing 11. The seals contribute to the creation of a sealed region within the annulus 12 that is defined at the top end by the trailing end section 2 of the annular packer 1 and at the bottom end by the leading end section 2*a* of the annular packer 1.

FIG. 2 shows a diagrammatic representation of the operation of the thermally deformable annular packer 1 to form an alloy seal within the annulus located between the inner tubing 10 and the outer casing/tubing 11. For the sake of clarity the cement, which would usually fill the surrounding annular space, is not shown.

In order to melt the alloy of the thermally deformable annular packer 1 a heater 13 is deployed down hole via the inner well tubing 10. Once in position adjacent the annular packer 1 on the inside the inner tubing 10, the heater 13 is activated to melt the eutectic/bismuth based alloy of the middle sections 3.

As the alloy 15 melts it slumps to the bottom of the sealed region. At the same time the fluids that are less dense than the alloy (represented in the Figures by gases/fluids 14), which can become trapped in the sealed region, accumulate at the top of the sealed region 16.

It will be appreciated that because the gases/fluids 14 are typically captured within the sealed region closer to the surface, where the environmental conditions are less extreme, the higher temperatures down-hole cause the gases to expand within the sealed region. This can lead to a pressure build-up within the sealed region. It will also be appreciated that the activation of the heater 13 further exacerbates the situation.

As a result, the gases/fluids 14 in the top part of the sealed region 16 can become highly pressurised. If left un-checked the pressure build-up could eventually deform or even burst the inner well tubing or the outer well tubing/casing. As the end sections will typically be held in position by the cement (and seals 4, 8) it is the tubing/casing 10,11 that represent the weakest point in the system and thus the place where structural failure is most likely to occur.

In order to prevent this the shown embodiment of present invention provides a pressure relief system that is configured to fail before the tubing/casing 10,11 and thereby avoid the need for expensive and time consuming repairs to the entire well.

The pressure relief system takes the form of one or more blind holes 7 provided in an end section or end sections of the thermally deformable annular packer. Although FIGS. 1 and 2 only show blind holes in the trailing end section, it is envisaged that one or more blind holes may additionally or alternatively be provided in the leading end section. Each blind hole 7 defines a void 21 with an opening 22 (shown in FIG. 3) that is blocked by a pressure actuated means 9.

Figure 3:
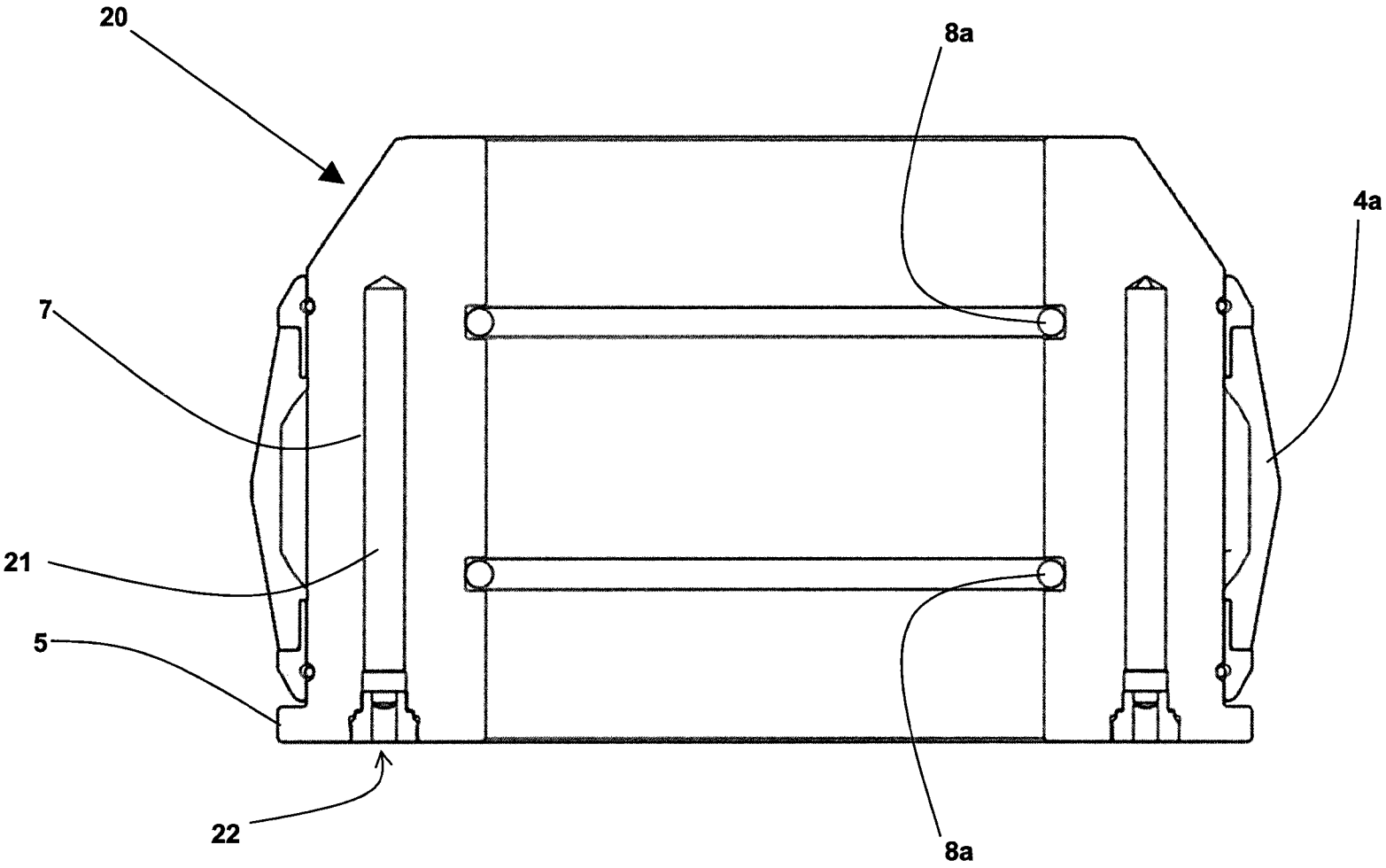
FIG. 3 shows a preferred embodiment of an end section of a thermally deformable annular packer of the present invention.

FIG. 3 shows a variation of the end section of the annular thermally deformable annular packer shown in FIG. 1. The end section 20 is shown in cross-section so that the inner and outer walls of the end sections tubular body can be appreciated.

As with the embodiment shown in FIG. 1, the end section 20 is provided with blind holes 7. The end section 20 is also provided with a tapered face at one end and a flange 5 on the opposite end. It will be appreciated that it is the flange end of the end section that comes into contact with the middle ring section in the stacked thermally deformable annular packer of the present invention.

The end section 20 shown in FIG. 3 differs from that shown in FIG. 1 by virtue of the external seal 4*a*, which is provided in the form of a single compressible rubber seal rather than two smaller ring seals 4. It is envisaged that the seals are self-energising.

The seals 8*a* provided on the inner wall of the end section 20 are similar to those provided on end sections 2, 2*a*.

In use, when subject to the pressure levels at the top of the sealed region 16, the pressure actuated means 9 fail and the blind hole is opened bringing the sealed region and the void space into fluid communication with one another. This rapid increase in the overall volume of the sealed region serves to reduce the pressure within the sealed region, thereby averting damage being done to the tubing/casing 10,11.

Although two blind holes 7 are shown in examples of FIGS. 2 and 3, it is envisioned that there may be more or less holes. However it is appreciated that the total number of holes will ultimately be limited by the need to maintain the structural integrity of the end section 2.

It is also envisioned that the number of blind holes 7 may be reduced by increasing the depth of the remaining blind holes.

The maximum depth of the blind holes will be determined by the length of the end section and it is envisaged that the blind hole must not extend so far into the end section that it weakens the end section (i.e. creates a weak spot at the base of blind hole where there is insufficient material of the end section left to maintain its structural integrity under increased pressure).

It will be also appreciated that the maximum diameter of the blind holes 7 will depend on the wall thickness of the end section. Once again it is important to ensure that the blind hole does not weaken the end section by removing too much material.

The maximum depth and diameter of the blind holes in the end section(s) will also vary depending upon the structural strength of the material used to manufacture the main body of the end section.

Essentially, the specific number and size of the blind holes is less important that the total volume of the combined voids of the blind holes (e.g. void space). This is because it is the total volume that dictates the level of pressure relief provided by the pressure relief system of the present invention.

It is appreciated that the total volume of the combined voids may be increased in line with the number of middle ring sections 3 sandwiched between the end sections. However, in general, it is envisaged that a void space of at least 33 ml (2 cubic inches) and preferably at least 66 ml (4 cubic inches) is sufficient.

By way of an example it is envisaged that this void space could be achieved in an end section made from steel with a wall thickness of 44.5 mm (1.75 inches) and an overall depth of 152.4 mm (6.00 inches) by providing a single blind hole with a diameter of 19.1 mm (0.75 inches) and a depth of between 127 mm (5.00 inches).

Alternatively, two holes with a diameter of 19.1 mm (0.75 inches) and depths of 63.5 mm (2.50 inches) could be adopted. It is also appreciated that increasing the number of holes in the end section further would enable further reductions in the blind hole depths and/or diameters.

It is envisioned that the pressure actuated means 9, which block the opening of each blind hole until a predetermined pressure level is reached within the sealed region, may take a number of forms. In this regard, two preferred embodiments of the pressure actuated means will now be described by way of reference to FIGS. 4 and 5.

Figure 4:
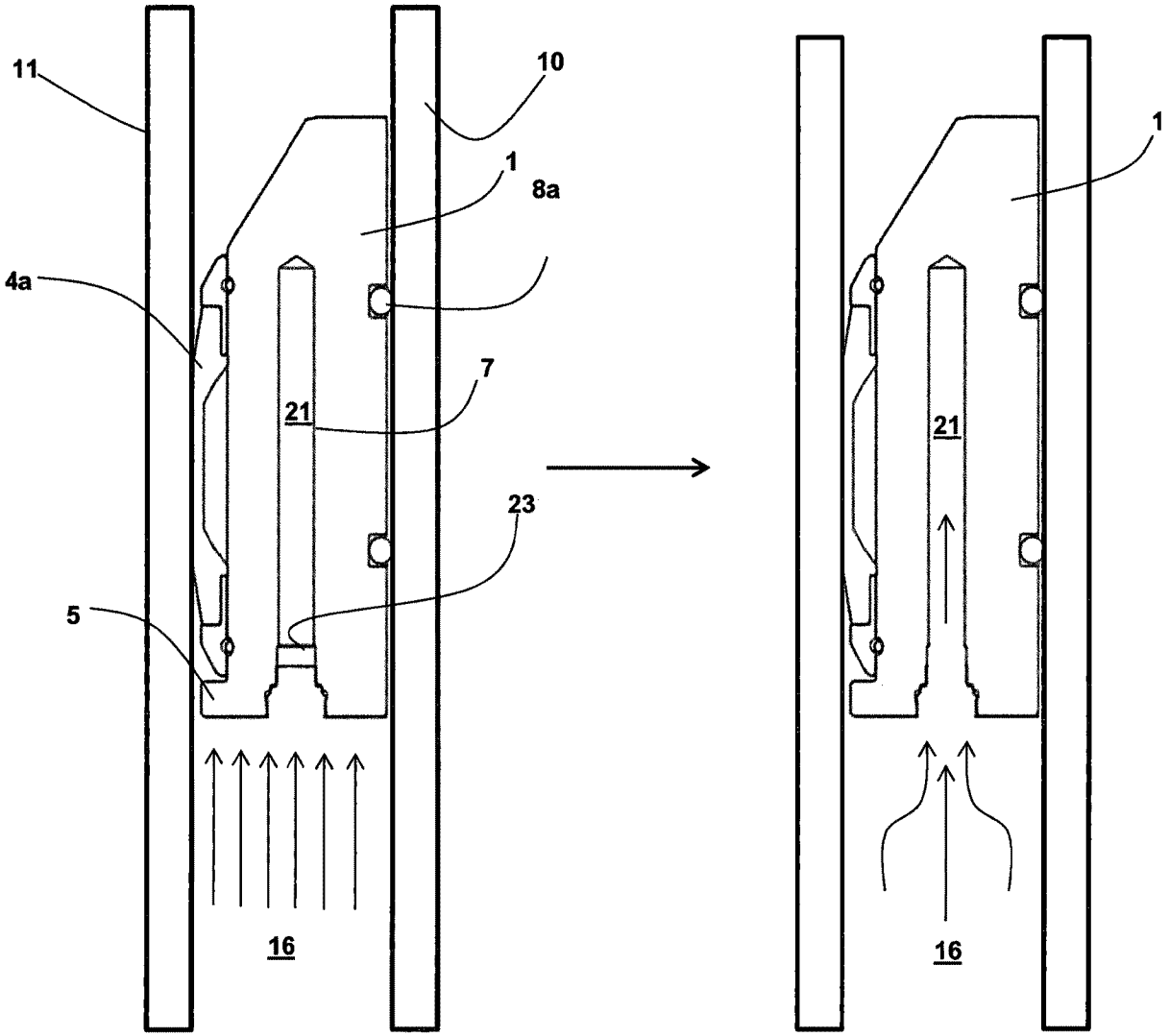
FIG. 4 shows a close up diagrammatic representation of the failure of the first embodiment of pressure actuated means.

FIG. 4 shows, in close up, two stages of the operation of a first preferred embodiment of the pressure actuated means, which takes the form of a pressure actuated device (PAD) 23.

The PAD, which is essentially a burst (or rupture) disc, is positioned in or across the opening 22 of each blind hole 7 so as to isolate the void 21 from the sealed region formed between the end sections of the thermally deformable annular packer 1. The opening of the blind hole 7 is preferably shaped to enable the PAD to be securely received across the opening and, in so doing, isolate the void below it from the sealed region. In this way each void is enclosed within the end section.

As will be appreciated by the person skilled in the art, such PADs can be configured to burst/rupture/fail at precise predetermined pressures. As a result, PADs represent a good choice for providing the pressure sensitive protection of the void volume that is required in the pressure relief system of first and second aspects of the present invention.

FIG. 4 shows the PAD 23 before failure, wherein the build-up of pressure within the top of the sealed region 16 is represented by the plurality of arrows. FIG. 4 also shows the PAD 23 after it has failed and the void 21 has been allowed into fluid communication with the top of the sealed region 16.

Once again, it will be appreciated that the increase in overall volume of the sealed region caused by the additional access to the void space 21 serves to reduce the pressure level within the sealed region.

Figure 5:
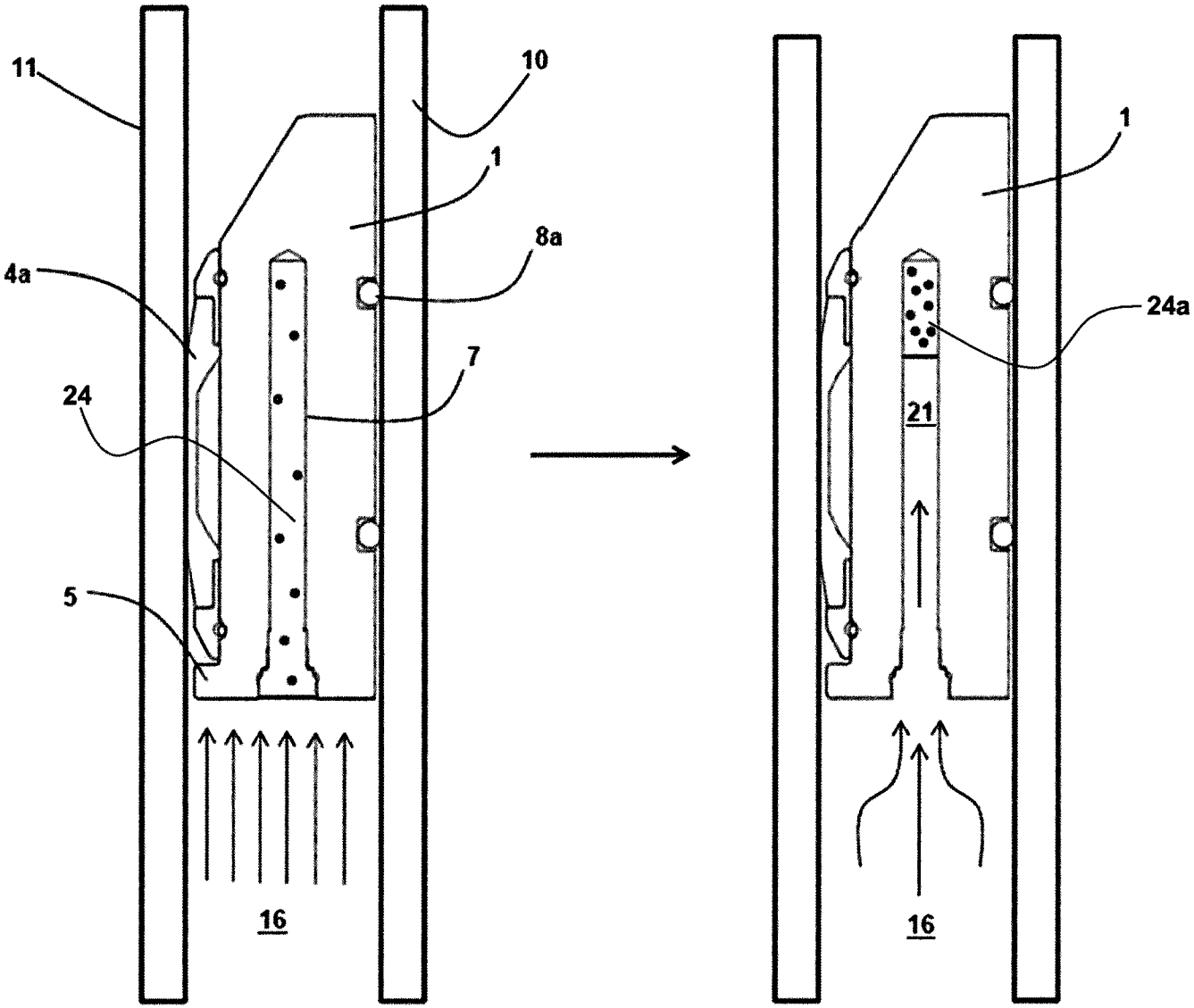
FIG. 5 shows a close up diagrammatic representation of the failure of the second embodiment of pressure actuated means.

FIG. 5 shows, also in close up, two stages of the operation of a second preferred embodiment of the pressure actuated means, which takes the form of a compressible material 24 that at least partially fills the void 21 of the blind hole 7. Suitable compressible materials include expanded foam and gels or rubber. However, it is envisaged that upon consideration of the described invention, the skilled person will readily appreciate other materials with suitable compressible characteristics for use in accordance with the present invention.

By at least partially filling, and preferable completely filling, the void with a material that is compressible under increase pressure (such as foam, plastic or rubber), the pressure actuation means of this embodiment can be configured to withstand compression until the pressure acting upon reaches a sufficient level to squash the material 24.

FIG. 5 shows the compressible material 24 before failure, when it fills the entire void 21 of the blind hole 7. Once again the build-up of pressure within the top of the sealed region 16 is represented by the plurality of arrows.

FIG. 5 also shows the material of the pressure actuated means in a compressed state 24*a*, wherein the material takes up a reduced amount of the void 21 of the blind hole 7. As the pressure actuated means is compressed at the bottom of the blind hole 7 the void space 21 within the blind hole is given over to the sealed region, thereby increasing the overall volume of the sealed region.

In view of this it is appreciated that the blind holes 7 employed in this embodiment may be made deeper than in the first embodiment so as to accommodate the compressed material 24*a* and still provide a significant void space 21.

Again, it will be appreciated that the increase in overall volume of the sealed region caused by the access to the void space 21 serves to reduce the pressure level within the sealed region 16.

It is envisaged that the void space or spaces need not to be located in the end section of the thermally deformable annular packer and they might alternatively be located in the middle ring sections of the packer instead.

Essentially, it is envisaged that, because the pressure relief within the sealed region of an annulus is achieved by effectively increasing the total volume within the sealed region, the advantageous technical effect can be obtained by releasing voids enclosed within the end section components and/or the middle ring section components of the thermally deformable annular packer of the present invention.

Figure 6:
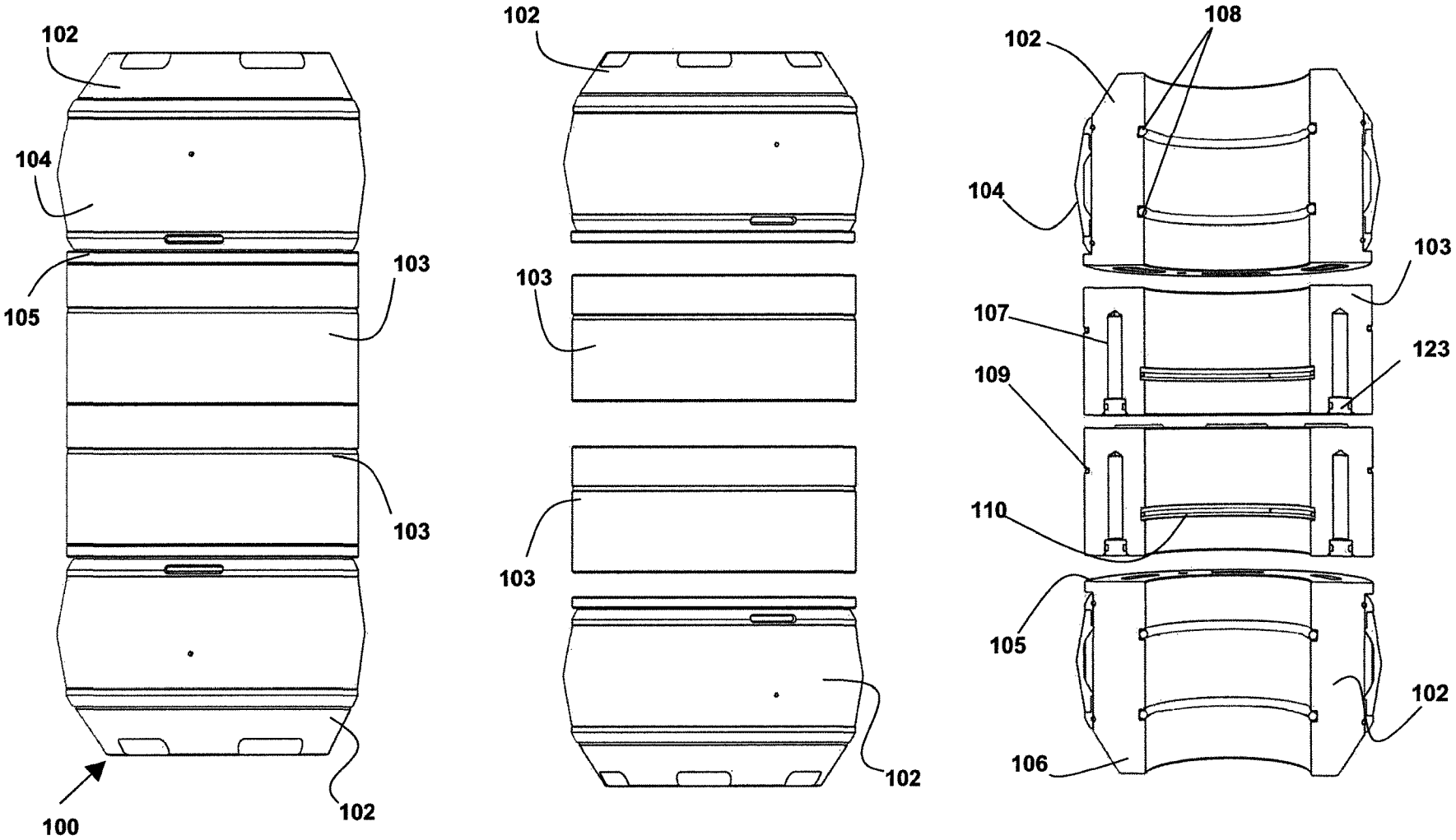
FIG. 6 shows various views of a stackable thermally deformable annular packer according to an alternative preferred embodiment of the present invention.

With this in mind we now turn to FIG. 6, which shows three views (a combined, an exploded, and a cross-sectional) of an alternative stackable thermally deformable annular packer 100 in accordance with the present invention. Once again, the annular packer 100 is shown without a well casing/tubing as such is not essential to the provision of an operational annular packer.

Again, as will be best appreciated from the exploded view, in the example shown the packer 100 is formed from two end sections 102 and two middle ring sections 103 all of which are joined together with connection means (not shown).

As with the end section shown in FIG. 3, seals 104 and 108 are provided on the outer and inner walls of the end sections 102 respectively.

Also as with the embodiment shown in FIG. 3, the end sections are provided with a flange 105 and a tapered end 106 provided on opposite ends thereof.

Unlike the embodiment shown in FIG. 3, however, the end sections 102 do not have blind holes. Instead, the blind holes 107 are provided in the eutectic/bismuth alloy of the middle ring sections 103. Each opening of the blind holes is capped off by a cap 123, which may be made from steel, so as to enclose void spaces within the tubular body of the ring section 103.

Therefore, unlike the end sections provided in the first and second aspects of the present invention, the end sections 103 provided in the third and fourth aspects of the present invention are provided with enclosed voids that can be exposed under predetermined conditions (i.e. melting temperature of the alloy ring section 103).

The middle ring section 103 will now be described in more detail with reference to FIG. 7, which shows a cross-sectional view of the ring section.

The middle ring section 103 comprises a tubular body 111 into which various features are formed, preferably by milling/drilling and turning of the alloy.

One of the features formed into the tubular body 111 is the blind hole 107. As noted above with regard to the placement of blind holes in the end section of the thermally deformable annular packer, the number, depth and diameter of the blind holes may be varied without departing from the general concept of the present invention.

As with the blind holes provided in the end sections of the previously described embodiments of the first and second aspects of the present invention, the total volume of the void space enclosed with the tubular body 111 of each ring section 103 is preferably at least 33 ml (2 cubic inches).

The provision of a cap 123 at the opening 122 of each blind hole serves to enclose the void space within the tubular body of the middle ring section 103. As mentioned above, the cap is preferably formed from a material such as steel. In this way the cap 123 has a suitable structural strength to maintain the enclosed void at down-hole pressures. The skilled person will appreciate that other materials with similar structural strength may be used instead without departing from the scope of the present invention.

Preferably the cap may be made from a material that melts at a similar temperature to the eutectic/bismuth alloy from which the ring sections are formed. In this way the blind hole cap may be absorbed into the alloy plug during the operation of the thermally deformable annular packer.

Other features provided in the tubular body 111 of the ring section 103 include the cement by-pass channels/conduits 112. As described in more detail in PCT/GB2015/052347, the conduits facilitate the passage of cement beyond the annular packer when it is poured or pumped into the annular space to form a cement seal.

In addition, the outer and inner walls of the tubular body 111 are provided with an outer recess 109*a* and an inner recess 110*a* respectively. These recesses receive inwardly biased spring rings and outwardly biased spring rings respectively.

Again, as described in more detail in PCT/GB2015/052347, upon melting of the alloy ring section 103 the spring rings act in concert as conduit clearance means to break up any cement that may have set within the by-pass conduits 112. This ensures the formation of a continuous alloy seal across the full diameter of the plug.

A yet further feature provided in the tubular body 111 is the complementary aperture 113, which forms part of the connection system that helps align neighbouring components of the stacked packer together. The placement of the aperture on each component of the stacked packer is constant so that they can be aligned with one another, using dowel pins for example, to ensure that all the by-pass conduits 112 also align. This ensures a continuous cement passage through the annular packer of the present invention.

Although the above-described embodiments show enclosed voids in either the end section component or the ring section component of the thermally deformable annular packer of the present invention, it is envisaged that a combination of both might be used to additional advantage without departing from the present invention.

Figure 8:
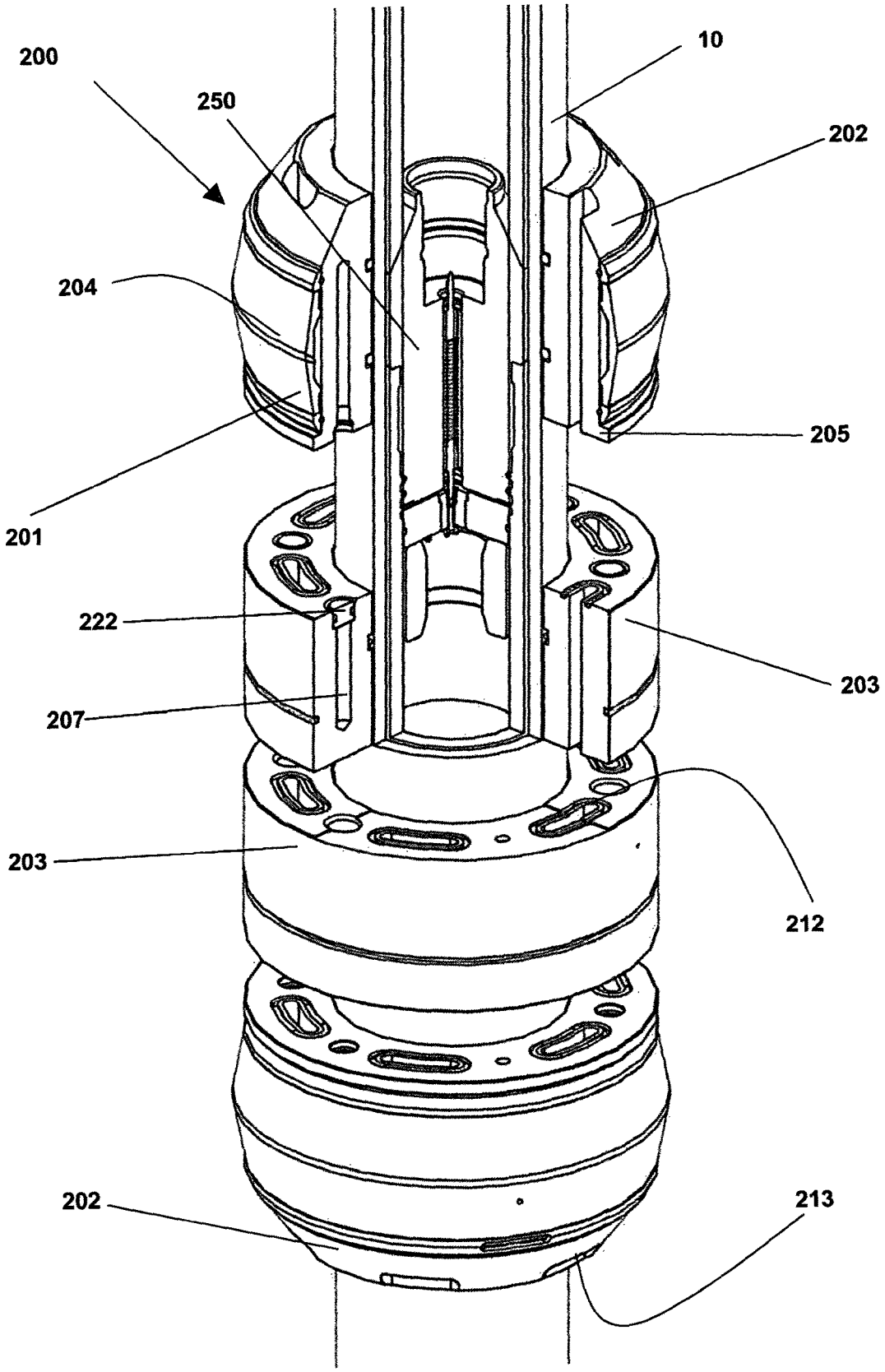
FIG. 8 shows a partially exposed view of a further preferred embodiment of the stackable thermally deformable annular packer of the present invention.

In this regard reference is now made to FIG. 8, which shows a partially exposed view of a thermally deformable annular packer 200 that comprises enclosed void space 201, 207 in both the end section component 202 and the ring section component 203.

The thermally deformable annular packer 200 is shown in situ upon an inner well tubing 10. The outer casing 11 has been omitted to allow the thermally deformable annular packer 200 to be viewed more clearly.

FIG. 8 also shows a heater assembly 250 inserted within the inner well tubing 10 at a location adjacent to the ring sections 203. It will be appreciated that this is the position the heater would assume when the thermally deformable annular packer 200 is being operated (i.e. melted) to form a seal in the annular space between the inner well tubing 10 and the outer well casing 11(not shown).

As the heater assembly, which may be a chemical reaction heater, has been described previously (e.g. see WO2011/151271 and WO2014/096857) it will not be covered in detail here.

Once again, the thermally deformable annular packer 200 is provided with cement by-pass channels/conduits 212. FIG. 8 clearly shows the alignment of the conduits along the full length of the stacked packer from the end section 202 at the leading end section, where the end section conduit 213 is provided, through the sandwiched ring sections 203 and on to the trailing end section, which is also provided with a conduit.

The invention claimed is:

1. A thermally deformable annular packer for use in oil and gas wells, said annular packer comprising a stack of component parts, said parts comprising one or more eutectic alloy based ring sections sandwiched between two end sections; and wherein at least one of the stacked component parts is provided with one or more enclosed voids that are configured to be exposed when the packer is subject to a predetermined pressure or temperature; wherein at least one of the annular packer end sections has one or more blind holes provided in a surface of the end section that faces into the stack, each blind hole comprising an opening in said surface and at least one of the voids within the end section; and wherein the opening of each blind hole is blocked by pressure actuated means configured to fail when subject to a predetermined pressure such that the enclosed void within the end section can be accessed through the opening.

2. The thermally deformable annular packer of claim 1, wherein the pressure actuated means comprises a pressure actuated device positioned at the opening of each blind hole.

3. The thermally deformable annular packer of claim 2, wherein the pressure actuated device comprises a burst/rupture disc.

4. The thermally deformable annular packer of claim 1, 2 or 3, wherein each void is either at a reduced pressure or completely evacuated when blocked.

5. The thermally deformable annular packer of claim 1, wherein the pressure actuated means comprises a compressible material positioned within, and at least partially filing, the void of each blind hole.

6. The thermally deformable annular packer of claim 5, wherein the compressible material is selected from foam, plastic or rubber material.

7. The thermally deformable annular packer of claim 1, 2 or 6, wherein, in use, said one or more blind holes are provided in the trailing annular packer end section.

8. The thermally deformable annular packer of claim 1, 3, or 5, wherein each void extends between 20% and 85% of the way into the body of said end section.

9. The thermally deformable annular packer of claim 1, wherein at least one of the annular packer end sections comprise a tapered region, which, in use, is located at a leading and/or trailing end of the stack.

10. The thermally deformable annular packer of claim 1, wherein the end sections comprise a flange that extends radially outwards beyond the ring sections.

11. The thermally deformable annular packer of claim 1, wherein each end section is provided with a compressible, preferably rubber, seal on an outer surface thereof, said compressible seal extending beyond the outer edge of end section.

12. The thermally deformable annular packer of claim 1, wherein, in use, the pressure actuated means is configured to fail at a pressure that is higher than down-hole pressure but lower than the pressure tolerance of the well casing and/or tubing located on either side of the sealed region of the annular space.

13. The thermally deformable annular packer of claim 1, wherein at least one of the annular packer ring sections is provided with one or more enclosed voids that are configured to become exposed when the ring sections melt.

14. The thermally deformable annular packer of claim 13, wherein the enclosed voids comprise blind holes provided in a surface of the ring section that faces other components of the stack, each blind hole comprising an opening in said surface and a void within the ring section; and wherein the opening of each blind hole is blocked by a cap that encloses the void of each blind hole.

15. The thermally deformable annular packer of claim 13, wherein each enclosed void is either at a reduced pressure or completely evacuated.

16. The thermally deformable annular packer of claim 13, 14 or 15, wherein the ring sections comprise one or more conduits extending between the component facing surfaces of the ring section.

17. The thermally deformable annular packer of claim 13, wherein a blind hole and the conduits are arranged in an alternating pattern around each ring section.

18. The thermally deformable annular packer of claim 13, wherein a blind hole are provided on more than one of the component facing surfaces of the ring section.

19. The thermally deformable annular packer of claim 1, or 13, wherein the total volume of the enclosed voids is at least 33 ml (2 cubic inches) and preferably at least 66 ml (4 cubic inches).

20. An end section component of a stacked thermally deformable annular packer for use in oil and gas wells, said end section comprising:

a tubular body with a first surface that, in use, faces towards an other component parts of the stacked thermally deformable annular packer;

at least one blind hole provided in the first surface, each hole comprising an opening in said surface and a void within the tubular body; and wherein the opening of each blind hole is blocked by pressure actuated means configured to fail when subject to a predetermined pressure such that the void within the end section can be accessed through the opening.

21. The end section component of claim 20, wherein the pressure actuated means comprises a pressure actuated device positioned at the opening of each blind hole.

22. The end section component of claim 21, wherein the pressure actuated device comprises a burst/rupture disc.

23. The end section component of claim 20, 21 or 22, wherein each void is either at a reduced pressure or completely evacuated when blocked.

24. The end section component of claim 20, wherein the pressure actuated means comprises a compressible material positioned within, and at least partially filing, the void of each blind hole.

25. The end section component of claim 24, wherein the compressible material is selected from foam, plastic or rubber material.

26. The end section component of claim 20, 21 or 22, wherein each void extends between 20% and 85% of the way into the tubular body.

27. The end section component of claim 20, 21 or 22, wherein the tubular body comprises a tapered region at the opposite end thereof to the first surface.

28. The end section component of claim 20, wherein the tubular body comprises a flange that, in use, extend radially outwards beyond any eutectic alloy based ring sections present in the stacked thermally deformable annular packer.

29. The end section component of claim 20, 21 or 22, wherein, in use, the pressure actuated means is configured to fail at a pressure that is higher than down-hole pressure but lower than the pressure tolerance of the well casings and/or tubing located on either side of the sealed region of the annular space.

30. The end section component of claim 20, 21 or 22, wherein the total volume of the voids is at least 33 ml (2 cubic inches) and preferably at least 66 ml (4 cubic inches).

31. The end section component of claim 20, 21 or 22, wherein the tubular body is formed from steel or aluminium.

32. A ring section component of a stacked thermally deformable annular packer for use in oil and gas wells, said ring section comprising: a tubular body formed from a eutectic or bismuth-based alloy, the body having a first surface that, in use, faces towards other component parts of the stacked 5 thermally deformable annular packer; and wherein the tubular body of the ring section is provided with one or more enclosed voids that are configured to become exposed when the ring sections melt; wherein the enclosed voids comprise blind holes provided in a surface of the ring section that faces other components of the stack, each blind hole comprising an opening in said surface and a void within the ring section; and wherein the opening of each blind hole is blocked by a cap that encloses the void of each blind hole within the tubular body of the ring section.

33. The ring section component of claim 32, wherein each enclosed void is either at a reduced pressure or completely evacuated.

34. The ring section component of claim 32, wherein the ring section comprises one or more conduits extending between the component facing surfaces of the ring section.

35. The ring section component of claim 32, wherein a blind hole and the conduits are arranged in an alternating pattern around each ring section.

36. The ring section component of claim 32, wherein a blind hole are provided on more than one of the component facing surfaces of the ring section.

37. The ring section component of claim 32, wherein the total volume of the enclosed voids is at least 33 ml (2 cubic inches).

* * * * *